United States Patent [19]

Maury

[11] 4,222,306

[45] Sep. 16, 1980

[54] DECOY-LAUNCHING PACKS FOR FOILING GUIDED WEAPON SYSTEMS

[75] Inventor: Louis Maury, Toulouse, France

[73] Assignee: Societe E. Lacroix, Muret, France

[21] Appl. No.: 882,197

[22] Filed: Feb. 28, 1978

[30] Foreign Application Priority Data

Mar. 7, 1977 [FR] France ..... 77 06587

[51] Int. Cl.[2] ..... F41F 1/00; F42B 4/26; F42B 13/42

[52] U.S. Cl. ..... 89/1 L; 102/89 CD; 102/37.8

[58] Field of Search ..... 89/1 L, 1 F, 1.816, 89/1.818; 102/89 CD, 37.8, 34.4, 63

[56] References Cited

U.S. PATENT DOCUMENTS

| | | | |
|---|---|---|---|
| 3,150,848 | 9/1964 | Lager | 102/89 CD X |
| 3,225,654 | 12/1965 | Barr | 102/89 CD X |
| 3,643,545 | 2/1972 | Nahas | 89/1 F |
| 3,708,563 | 1/1973 | Sells | 89/1.816 X |
| 3,797,394 | 3/1974 | Thurston et al. | 102/89 CD X |
| 3,808,940 | 5/1974 | Schillreff et al. | 89/1 L X |
| 3,841,219 | 10/1974 | Schillreff | 102/37.8 X |
| 4,012,985 | 3/1977 | Magnusson | 89/1.818 |
| 4,031,828 | 6/1977 | Larson | 102/89 CD X |
| 4,063,485 | 12/1977 | Carter et al. | 89/1.816 |
| 4,069,762 | 1/1978 | Maury | 102/37.8 X |

*Primary Examiner*—David H. Brown

*Attorney, Agent, or Firm*—Christie, Parker & Hale

[57] ABSTRACT

A decoy-launching pack for mounting on a directional carriage for foiling or frustrating weapons guidance systems. The pack comprises a rigid base suitable for positioning in a predetermined manner on said carriage, a firing means incorporated with said base for operation in conjunction with a firing-control component integrated in said carriage when said base is located thereupon, and a support located above and secured to said base and having the rack-shaped upper surface defining predetermined angled slopes. A firing transmission pyrotechnical chain extends from said firing means to the level of said angled slopes of the upper surface of said support, and a plurality of mortars are arranged with an ejection charge at the bottom bearing upon said angled slopes of said upper surface of said support, said mortars being predirected in the same plane, according to predetermined angles related to those of said angled slopes of the support surface. At least one decoy carrying projectile is located within each mortar.

27 Claims, 6 Drawing Figures

DECOY-LAUNCHING PACKS FOR FOILING GUIDED WEAPON SYSTEMS

Figure 1:
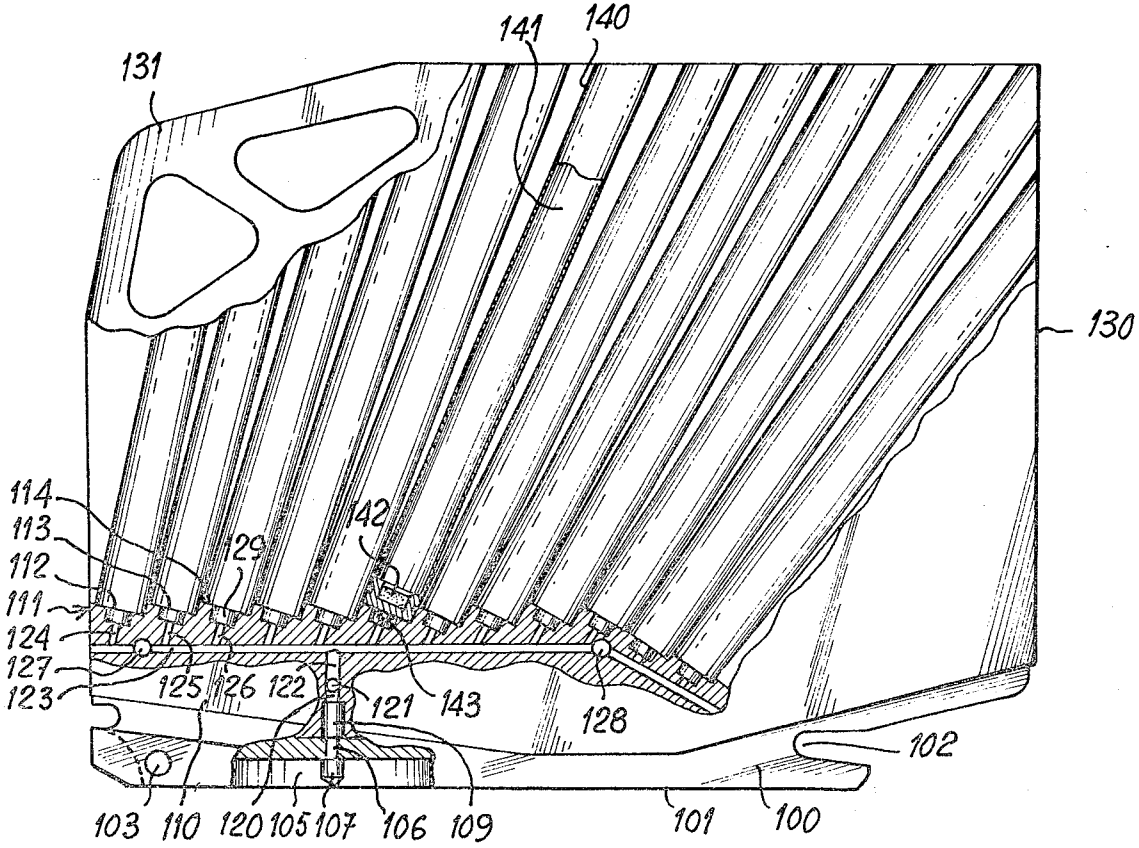

The invention relates to the foiling of so-called "anti-surface" guided-weapons systems, and is applicable particularly in the case of the defence of vessels against self-guiding missiles or guided artillery fire. In order to simplify matters, the following is limited to the particular example of self-guiding missiles.

A self-guiding missile guides itself automatically, detecting the position of the vessel by electromagnetic means such as radar and/or guiding means operating within the bands such as infra-red and/or visible or sensitive to the inherent radiation of the vessel. Defence against such a missile is generally effected by means of the operation of decoys from the vessel, after the missile has been tracked. The tracking operation does not always indicate the nature of the missile and both electromagnetic as well as infrared decoys are thus emitted simultaneously.

The electromagnetic decoys consist of chaff-like particles, generally consisting of metallized fiberglass. By emitting a large number of such chaff-like particles, it is possible to form an electromagnetic echo which is greater than that of the vessel, and the missile on-board radar then guides it towards the dominant echo due to the decoys rather than towards the vessel.

For an infra-red guidance missile, mixtures are launched from the vessel which will burn and produce an infra-red radiation comparable with- though greater- than that of the vessel. There again, the missile is directed towards the cloud of infra-red decoys. The visible radiation brightness of infra-red decoys is also of a nature to foil automatic pursuit means operating by visible optics.

The invention allows improved means for effective defence of vessels against self-guided missiles.

The main purpose of the invention is the rapid operation of the decoys after tracking of the missile, more particularly within a delay of less than 3 seconds.

Another purpose of the invention is to reduce the quantity of decoys to a minimal level by operational means adapted to the direction of origin of the missile. The decoys are located in an essentially co-planar manner, in a direction which is essentially perpendicular to the missile-vessel -axis.

Another purpose of the invention is the joint-localized emission on the one hand of electromagnetic-type decoys and on the other hand of infra-red-type decoys. To this end, accurate positioning means are provided at the decoy-emission level, whilst the dispersal-points for the decoys are also accurately defined.

The invention also aims at providing a cloud of electromagnetic decoys of sufficient quality to foil self-guided missiles having a very fine electromagnetic radar impulse.

Similarly, in the case of an infra-red guided missile, the invention allows the emission of a cloud of infra-red decoys having a progression which faithfully reproduces the normal movement of a vessel.

The essential aim of the invention is a decoy-launcher unit, intended for mounting on a directional carriage on the vessel, for the purpose of anti-missile defence of the vessel.

The unit comprises:

a rigid base allowing positioning in a predetermined manner on the carriage, suitably associated with a housing forming a sealed container together with it, a firing unit, incorporated with the base and able to operate in conjunction with a firing control mounted within the carriage, when the base is located upon it, a support located inside the housing, above the base, integral with the base, and providing a greater area in the form of a rack, defining predetermined sloping angles, a pyrotechnical firing transmission chain, starting from the firing unit and ending at the level of the sloping angles of the upper bearing surface of the support, multiple mortars comprising an ejection charge at the bottom and bearing on the sloping angles of the upper face of the support, the mortars being pre-directed in the same flat direction, according to predetermined angles linked with those of the bearing surface, and within each mortar, at least one projectile carrying decoys.

At the moment of firing, each projectile fractures the housing at the level of the mortar outlet. Consequently, before firing, the unit floats, but it will sink after firing.

The firing unit preferably comprises two electrodynamic energization triggers located in an enclosed housing, whereas the pyrotechnical chain is interlinked and has double firing distribution means.

According to an important aspect of the invention, the ejection charges include pyrotechnical ignition delays which are staggered in time, thus allowing the spread of projectile launching moments and consequently of the stresses imposed on the carriage. As may be seen further on, this allows the avoidance of random distortion in the decoy clouds, due to the effect of the wind.

According to another important aspect of the invention, at least a number of the projectiles have a rotary percussion component actuated on leaving the mortar, and itself triggering a pyrotechnical delay in the trajectory, controlling the release of the decoys from their container.

In consequence, there is no continuous pyrotechnical chain between the ejection charges of these projectiles and their release charges from their containers, thus ensuring a high degree of safety from the pyrotechnical viewpoint.

The projectiles are preferably of the double containerrelease type triggered by the rotary percussion and its pyrotechnical delay, and include on either side of the percussion component, two decoy container-release charges actuated by the pyrotechnical delay, and two decoy loads. At this point, slightly different pyrotechnical delays allow separation of the two container-release points, with a better spread of the cloud.

In a first type of unit, the projectiles are electromagnetic decoy-launchers, and comprise in the same envelope, a trajectory pyrotechnical delay and a container-release charge connected thereto, actuating dispersal means for the electromagnetic decoys.

In this case, the projectiles are distributed in groups within each of which they are associated the same ejection charge, consequently with the same initial speed, and have the same trajectory pyrotechnical delay. The projectiles in each group are located in mortars having staggered sloping angles, so that the container-release points for the decoys correspond with essentially equidistant sections of a crown.

In order to minimize the random influence of the wind, projectiles within a same group are associated with very closely adjoining ignition pyrotechnical delays, these being all the smaller as the initial speeds are high.

Finally, the electromagnetic decoy lengths are diversified to cover the frequency band extending from 7 to 18 GHz, with an essentially uniform spectral density.

In a second type of unit or pack, the projectiles are infra-red decoy-launchers, and comprise within the same housing at least one trajectory pyrotechnical delay able to initiate an infra-red diffusion charge, which spreads and ignites an infra-red mixture. Preferably, in the order of increasing angles of the mortars in relation to the horizontal, the projectiles are associated with very closely adjoining and increasing pyrotechnical ignition delays.

The projectiles associated with the smallest angles therefore always start first in order to ensure the "acquisition" of the infra-red decoy in the vicinity of the vessel. The other so-called "holding" projectiles include a rear parachute arranged to open after a predetermined delay, and a cap-rocket in which the percussion is actuated on impact in the water, and itself controlling a primary container-release charge which raises the projectile to a predetermined level above the water, whilst the ignition of the infra-red mixture occurs after the aforesaid trajectory pyrotechnical delay, counting from the time of the primary release from the container.

To that purpose for instance, the parachute is normally enclosed in a casing located to the rear of the projectile, and released as a result of the action of a casing-opening pyrotechnical charge, and the projectile comprises a pyrotechnical delay on opening of the parachute, ignited by the ejection charge and reacting on the said opening charge, the said opening delay being selected so that the opening occurs in the vicinity of the location before the high point of the projectile trajectory.

The parachute opening delays defining the essential part of the delay on actuation of the projectile, are preferably increasing in the sequence of the increasing angles of the mortars in relation to the horizontal, whereas the trajectory pyrotechnical delays are all equal on projectiles fitted with a parachute, the latter delay defining the operational level of the infra-red decoys above the water.

Finally, the infra-red mixture is selected for a brightness distributed over the wavelength bands extending from 3 to 5 microns and from 8 to 14 microns, the second band comprising a brightness spectral density approximately twice that of the first band.

The invention also relates to a group of units comprising one or several electromagnetic decoy-launcher units and at least one infra-red decoy-launcher unit, intended to be used jointly.

Figure 2:
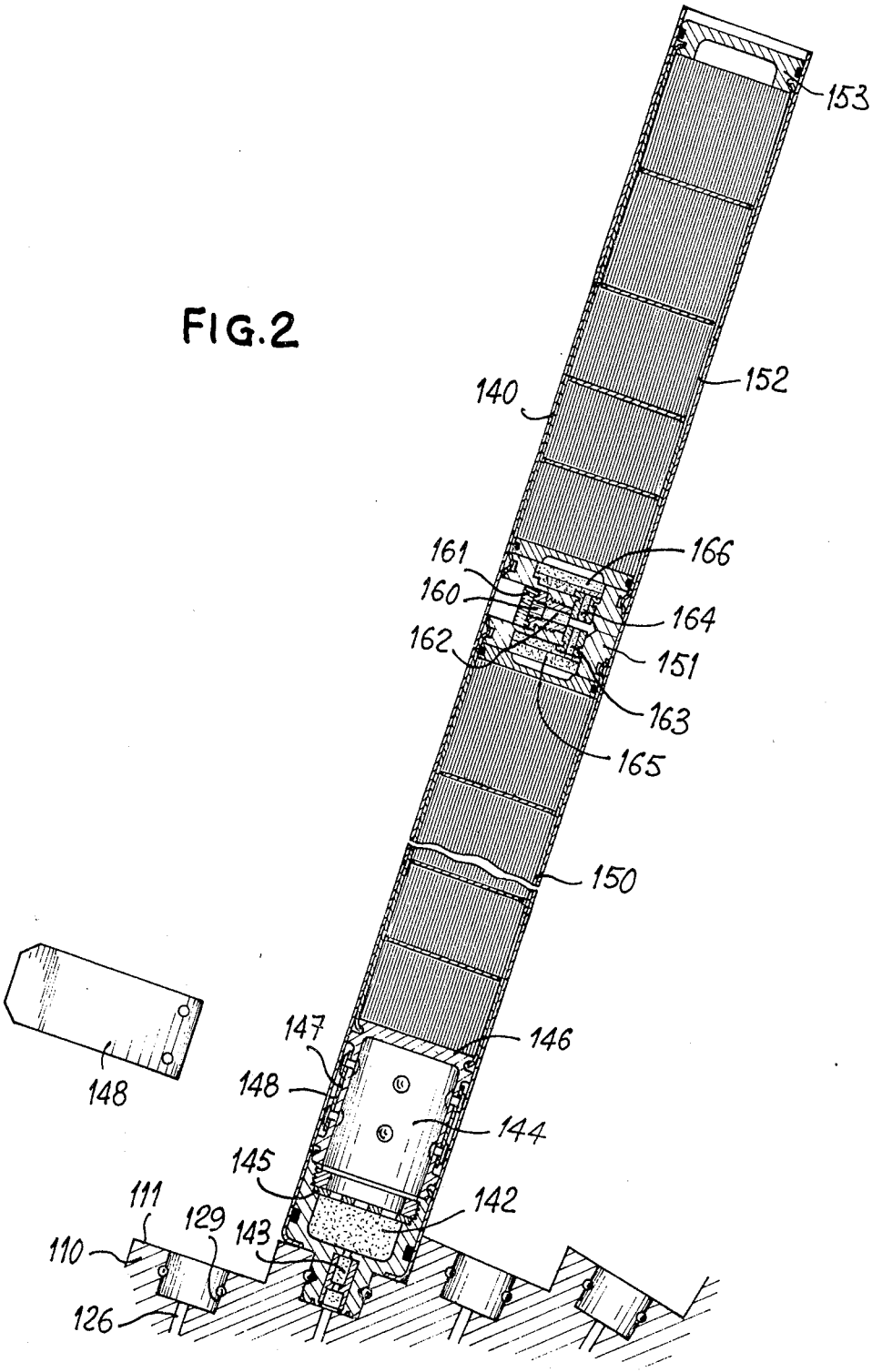
Figure 3:
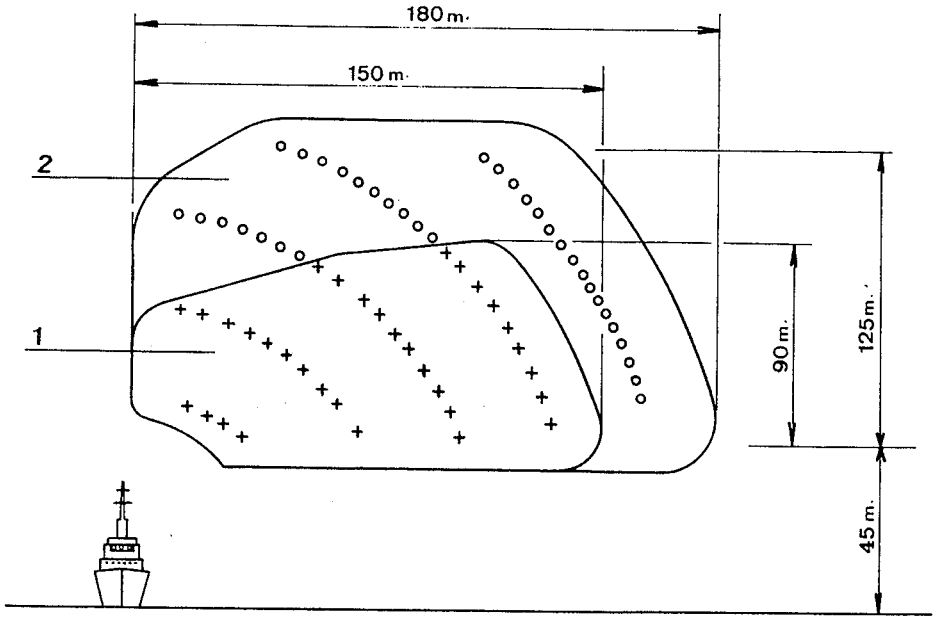
Figure 4:
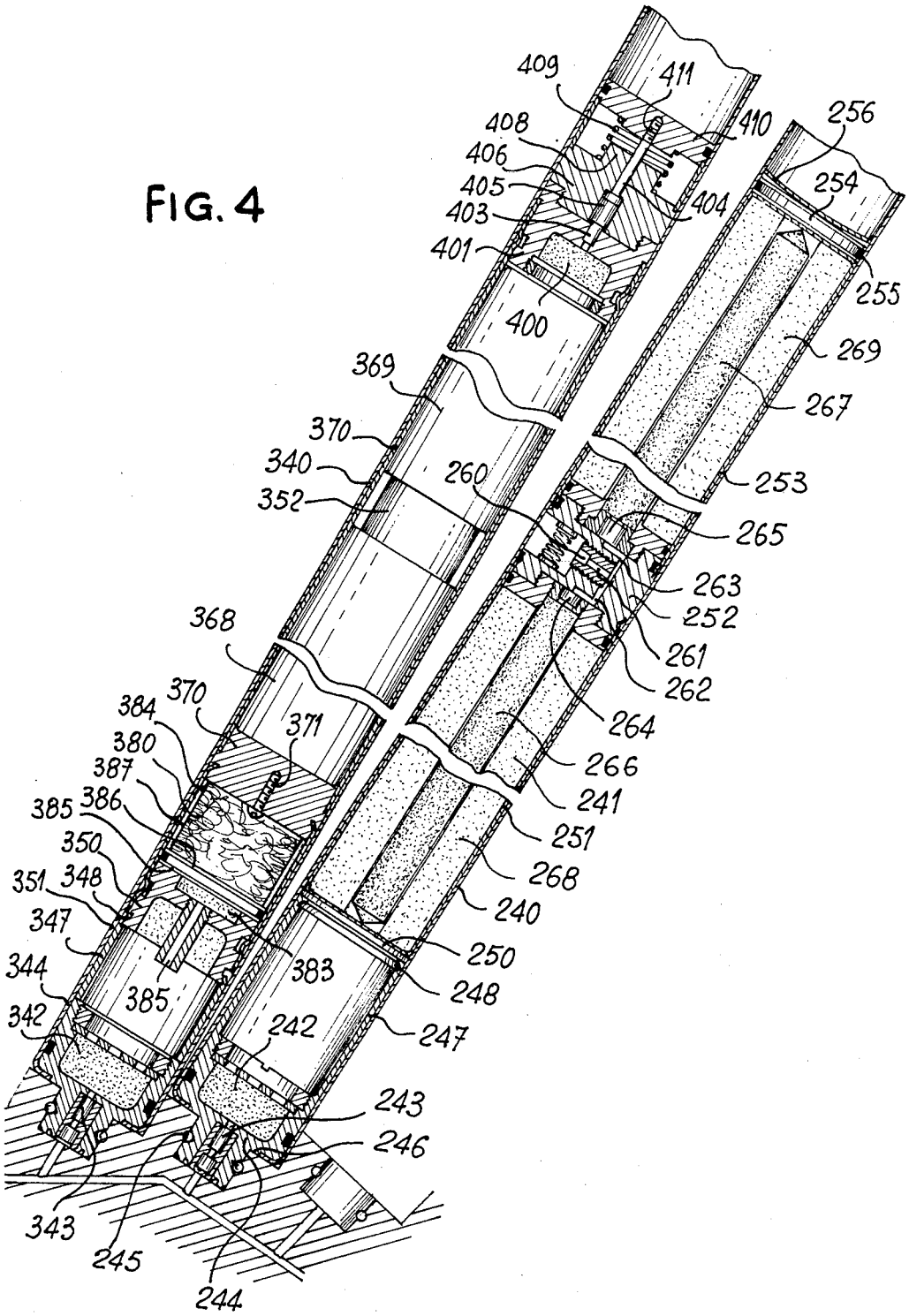
Figure 5:
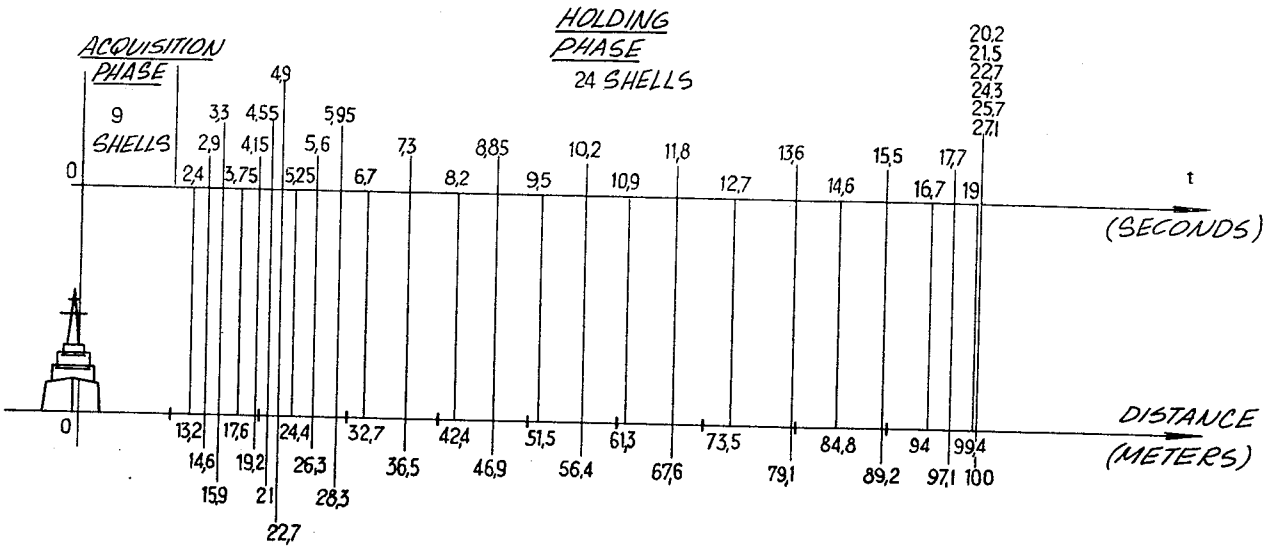
Figure 6:
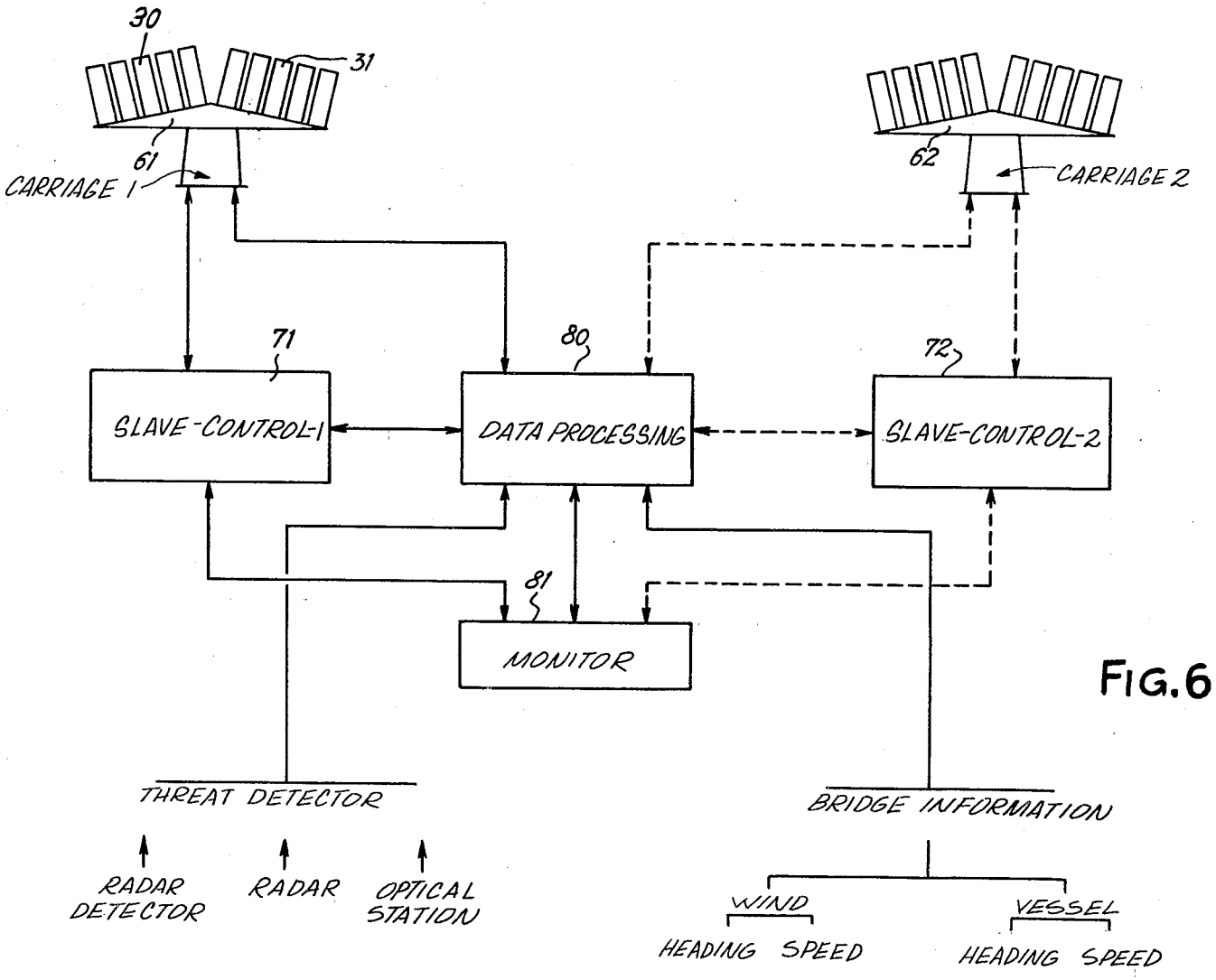

Other characteristics and advantages of the invention will be seen on reading the detailed description which follows, with reference to the enclosed drawings, given as non-restrictive examples, and wherein:

FIG. 1 represents a sectional view of the decoy-launcher according to the invention, FIG. 2 shows a section through an electromagnetic decoy-launcher projectile in its mortar, defining a first type of decoy-launcher pack according to the invention, FIG. 3 shows an electromagnetic decoy cloud obtained with two complementary electromagnetic decoy-launcher packs in accordance with the invention, FIG. 4 shows a section through two types of projectiles forming part of the infra-red type of decoy-launcher pack, FIG. 5 shows a space/time diagram illustrating the characteristics of a cloud of infra-red decoys obtained with the infra-red decoy-launcher pack according to the invention, and FIG. 6 shows the general characteristics of an installation in which electromagnetic- and infra-red- decoy-launcher packs according to the invention are incorporated.

The decoy-launcher pack in FIG. 1 bears the general reference number 1. It has a rigid base 100 fitted in the lower part with a flat sole 101, allowing the positioning of the base and consequently of the pack, in a predetermined manner on a carriage which is defined at a later stage. The base 100 has front securing means 102 and rear securing means 103, whereby it is integral with the carriage. A housing 130 is mounted on the base 100, the two components thus defining a sealed casing.

A firing unit is incorporated in the base. This firing unit is located in an enclosed firing-casing 105. It comprises two electrical triggering units (1 ampere, 1 watt), of which one only is visible in the sectional view of FIG. 1 (reference 106). The triggers such as 106 are connected to induction coils 107, which come flush in the vicinity of the sole 101 of the base. They are thus able to operate in conjunction with a firing control incorporated in the carriage, when the base 100 is integral with the carriage. The two electrical triggers subject to induction energization actuate the same ignition charge 109.

Inside the housing 130 and above the base, a support 110 is located. The upper surface 111 of the support is in the form of a rack, and has circular sloping parts such as 112, 113 and 114, respectively defining the predetermined inclined angles.

A firing transmission pyrotechnical chain is located within the support 110. The said chain starts from the firing unit, i.e. the primary ignition charge 109, and ends at the level of the sloping angles of the upper bearing face of the support, essentially at the center of each circular part such as 112, 113 and 114.

The pyrotechnical chain is latticed and has a double firing distribution. Starting from the primary charge 109, the chain has a first short portion 120 feeding a first firing distribution channel 121 which extends transversely to the plane of FIG. 1. Starting from the firing distribution channel 121, the chain also comprises rising portions 122 which finally end in a firing distribution network 123. The said firing distribution network 123 itself feeds the end-portions of the chain, such as 124, 125 and 126, which end in the middle of the circular portions 112, 113 and 114 defining the aforesaid sloping angles.

The pack assembly is essentially intended on the whole to admit several adjacent rows of mortars and projectiles, which come to bear upon circular inclined portions such as 112, 113 and 114. A firing distribution network such as 123 is associated with each of these rows. The networks are interconnected by second transverse channels such as 127 and 128. In consequence the structure is latticed and ensures the double firing distribution of the pyrotechnical chain.

Essentially at the center of the inclined sloping areas such as 114, holes for retaining pins 129 are provided. Each of the said inclined circular areas thus allows the securing of mortar such as 140, having one or several projectiles. The sectional view in FIG. 1 shows 12 mortars, though only one is shown with its projectile, in order to simplify the drawing. It is clear that all the mortars have at least one projectile. The mortar apertures such as 140, end beneath the upper face of the housing 130. The mortars are pre-directed in a same plane. In this case there is a total of 12 units, and their angles of fire are associated with the predetermined angles defined by the bearing face of the support 110.

The pack is fitted internally with three rows of mortars such as that shown in FIG. 1, and transversely superimposed in the figure. The total number of pre-directed mortars in the present preferred pack design is 33. The arrangement thus selected allows the necessary space for the release-handle 131 in two of the three sets of mortars.

At the base each mortar 140 has an ejection charge 142, connected to the firing pyrotechnical chain by means of a firing delay 143.

According to an important feature of the invention, the pyrotechnical delays such as 143 which are arranged at the bottom of the mortars are spaced in time, thus allowing the timed spread of the launching of the projectiles such as 141, and consequently the spread of the stresses imposed of the carriage.

The projectiles 141 are decoy-carriers, for electromagneticor for infra-red- decoys. These decoys are released from their containers at the end of a predetermined trajectory timing. The container release in a design not shown here, may be ensured by means of an internal pyrotechnical chain within the projectile and controlled by the ejection charge.

However, in the preferred design, the decoy containerrelease is controlled by a rotary percussion unit, thus making the container-release independent from the ejection pyrotechnical chain, hence an improved level of pyrotechnical safety.

In a variation on the design, the decoys are released from their containers by means of a striker, which is actuated by the ejection of a pin as the mortar takes off.

The principle of the rotary striker is to rotate about a shaft which is eccentric in relation to the axis of the projectile, in such a manner that it is locked by the mortar-wall so long as the projectile remains inside it. On the other hand the striker hits the primer as soon as the projectile leaves the mortar. Naturally where the projectile is under double casing, the rotary striker only operates when the projectile issues from its internal casing.

According to the invention, the rotary striker itself ignites at least one trajectory pyrotechnical delay, which controls the release of the decoys from their containers.

In the preferential design, the projectiles are of the double container-release type, comprising two decoy charges placed on either side of the rotary striker. This striker controls at least one pyrotechnical delay, preferably two delays which may be slightly different, which in turn fire two decoy-releasing charges.

The preferred design for the electromagnetic decoy launching projectile is now described more closely, with reference to FIGS. 2 and 3.

FIG. 2 shows the rack-shaped upper part 111 of the support 110 for the pack in FIG. 1. The central bores such as 129, receiving the mortars can also be seen, and at the bottom of the bores the terminal components such as 126 for the ignition pyrotechnical chain. In the same FIG. 2, a mortar 140 enclosing a projectile 141 is illustrated. In its lower part the mortar 140 comprises the ignition pyrotechnical delay 143, followed by the ejection charge 142. The latter charge communicates with the expansion-compartment 144 by way of the vents in a grid 145. In its end part the projectile 141 has a generally cylindrical shell case 146, closed towards the projectile and open towards the expansion-compartment: the cylindrical external wall 147 of the shell-case may be released externally to allow the insertion of collapsed vanes 148 in the recess. The vanes open out after the projectile leaves the mortar, and form a flight-stabilizer means for the projectile assisting its alignment with the direction of the trajectory.

The remainder of the electromagnetic decoy-launching projectile consists of a first casing 150 connected on the one hand to the shell case 146 of the projectile, and on the other hand to the rotary striker 151. The rotary striker is itself also connected to a second casing 152, which is itself finally connected to the front part 153 of the projectile.

The rotary striker 151 shows the primer 160 and the spring 161 bracing the striker, which is not visible since it is located behind the primer assembly. The primer 160 feeds a first chain 162, which may include a pyrotechnical delay applicable to both decoy-charges. Subsequently, the first charge feeds transverse pyrotechnical relays 163 and 164 which may also have pyrotechnical delays which are preferably slightly different. These relays 163 and 164 react respectively on the container-release charges 165 and 166. These trigger on either side of the rotary striker the opening of the casings and consequently the release of the electromagnetic decoys.

In general the projectile as just described has at least one trajectory pyrotechnical delay and at least one containerrelease charge connected thereto and actuating dispersal means for the electromagnetic decoys.

As an alternative, the projectile according to French Pat. No. 76 07769 may be used, or projectiles based on rockets described in French Pat. Nos. 74 41206 and 75 02541.

Tables 1 and 2 show for the purposes of example, the specific features of two differing versions of the electromagnetic decoy-launcher pack. The pack in Table 1 may be used on its own, whereas the pack in Table 2 is intended for use jointly with the other, in order to obtain a large-size cloud in the case of larger vessels.

The parameters of the Tables are the angle of elevation A, the ejection delay $r_o$, the speed $V_o$ which is obviously linked to the characteristics of the ejection charge, and the trajectory delay t. (It is possible that the pack support on the carriage is also sloping; in that case the figures given for angle A include that slope).

It will be seen in the Tables that the projectiles are distributed in groups indicated by the broken lines. In each group the projectiles have the same initial speed, and the same trajectory pyrotechnical delay.

TABLE 1

| No. | A | $r_o$(s) | $V_o$m/s | t(s) |
|---|---|---|---|---|
| 1 | 84° | 0.3 | 50 | 1.1 |
| 2 | 78° | 0.3 | 50 | 1.1 |
| 3 | 70° | 0.3 | 50 | 1.1 |
| 4 | 62° | 0.3 | 50 | 1.1 |
| 5 | 86° | 0.3 | 70 | 1.2 |
| 6 | 82° | 0.25 | 70 | 1.2 |

TABLE 1-continued

| No. | A | $r_o$(s) | $V_o$m/s | t(s) |
|---|---|---|---|---|
| 7 | 78° | 0.25 | 70 | 1.2 |
| 8 | 74° | 0.25 | 70 | 1.2 |
| 9 | 63° | 0.25 | 70 | 1.2 |
| 10 | 60° | 0.25 | 70 | 1.2 |
| 11 | 36° | 0.2 | 70 | 1.2 |
| 12 | 48° | 0.2 | 70 | 1.2 |
| 13 | 44° | 0.8 | 70 | 1.2 |
| 14 | 36° | 0.2 | 70 | 1.2 |
| 15 | 64° | 0.2 | 90 | 1.3 |
| 16 | 60° | 0.15 | 90 | 1.3 |
| 17 | 54° | 0.15 | 90 | 1.3 |
| 18 | 50° | 0.15 | 90 | 1.3 |
| 19 | 48° | 0.15 | 90 | 1.3 |
| 20 | 42° | 0.15 | 90 | 1.3 |
| 21 | 38° | 0.1 | 90 | 1.3 |
| 22 | 34° | 0.1 | 90 | 1.3 |
| 23 | 30° | 0.1 | 90 | 1.3 |
| 24 | 24° | 0.1 | 90 | 1.3 |
| 25 | 46° | 0.1 | 100 | 1.5 |
| 26 | 44° | 0.07 | 100 | 1.5 |
| 27 | 40° | 0.07 | 100 | 1.5 |
| 28 | 38° | 0.07 | 100 | 1.5 |
| 29 | 36° | 0.07 | 100 | 1.5 |
| 30 | 32° | 0.07 | 100 | 1.5 |
| 31 | 28° | 0.03 | 100 | 1.5 |
| 32 | 26° | 0.03 | 100 | 1.5 |
| 33 | 22° | 0.03 | 100 | 1.5 |

TABLE 2

| No. | A | $r_o$(s) | $V_o$m/s | t(s) |
|---|---|---|---|---|
| 1 | 88° | 0.35 | 90 | 1.3 |
| 2 | 84° | 0.35 | 90 | 1.3 |
| 3 | 80° | 0.35 | 90 | 1.3 |
| 4 | 76° | 0.3 | 90 | 1.3 |
| 5 | 72° | 0.3 | 90 | 1.3 |
| 6 | 68° | 0.3 | 90 | 1.3 |
| 7 | 76° | 0.2 | 100 | 1.5 |
| 8 | 74° | 0.2 | 100 | 1.5 |
| 9 | 70° | 0.2 | 100 | 1.5 |
| 10 | 68° | 0.2 | 100 | 1.5 |
| 11 | 66° | 0.15 | 100 | 1.5 |
| 12 | 64° | 0.15 | 100 | 1.5 |
| 13 | 62° | 0.15 | 100 | 1.5 |
| 14 | 58° | 0.15 | 100 | 1.5 |
| 15 | 56° | 0.15 | 100 | 1.5 |
| 16 | 52° | 0.15 | 100 | 1.5 |
| 17 | 48° | 0.15 | 100 | 1.5 |
| 18 | 52° | 0.1 | 120 | 1.5 |
| 19 | 50° | 0.1 | 120 | 1.5 |
| 20 | 48° | 0.1 | 120 | 1.5 |
| 21 | 46° | 0.1 | 120 | 1.5 |
| 22 | 44° | 0.1 | 120 | 1.5 |
| 23 | 42° | 0.1 | 120 | 1.5 |
| 24 | 40° | 0.07 | 120 | 1.5 |
| 25 | 38° | 0.07 | 120 | 1.5 |
| 26 | 36° | 0.07 | 120 | 1.5 |
| 27 | 34° | 0.07 | 120 | 1.5 |
| 28 | 32° | 0.07 | 120 | 1.5 |
| 29 | 30° | 0.03 | 120 | 1.5 |
| 30 | 28° | 0.03 | 120 | 1.5 |
| 31 | 26° | 0.03 | 120 | 1.5 |
| 32 | 24° | 0.03 | 120 | 1.5 |
| 33 | 22° | 0.03 | 120 | 1.5 |

The projectiles in the same group are associated with closely adjoining ignition pyrotechnical delays, and these are all the smaller as the initial speeds are high.

It should be noted that the projectiles in each group are arranged in mortars with cascade-like angles of elevation, so that the container-release points for the decoys come in essentially equidistant portions of a crown, which is an important characteristic of the invention.

FIG. 3 shows the cloud of electromagnetic decoys which is obtained by launching simultaneously the two types of packs defined in Tables 1 and 2. The container-release points shown by the symbol (+) relate to the Table 1 pack, and the container-release points indicated by small circles relate to the pack according to Table 2.

Other versions of the electromagnetic decoy-launcher pack may be designed on the same principles as the pack in Table 1, for vessels of smaller dimensions.

As previously indicated, the length of the chaff particles differ to cover the frequency band extending from 7 to 18 GHz, with an essentially uniform spectral density. Experiments by the applicant also show that the cloud shown in FIG. 3, the spatial distribution of the decoys is also practically uniform (fluctuations of 0 to 1 dB over the equivalent radar area).

It is particularly important to ensure that the priorly described uniform spectral density be provided in order to decoy all self-directed missiles having radar guidance.

As may be seen in FIG. 3, the cloud which is obtained is essentially flat. The horizontal dimension of the decoy cloud goes from 150 to 180 meters. The base of the cloud is located at approximately 45 meters above the water. The part of the cloud which is due to the pack according to Table 1 measures 90 meters high, and the whole of the cloud measures 125 meters high. The flat nature of the cloud is important under the same conditions, to ensure the most effective use of a predetermined quantity of decoys. This feature is also most important to decoy radar-guided self-directed missiles having a very fine electromagnetic impulse.

A description is now given for the infra-red decoy-launcher pack according to the invention, with reference to FIGS. 4 and 5.

In the preferential design, there is only one version of the infra-red decoy-launcher pack, but it comprises two types of projectiles. The number of projectiles is 33, as previously.

The pack comprises 9 so-called acquisition projectiles, which are launched first in order to ensure initial acquisition if the bright spot of the infra-red decoy is in the vicinity of the vessel. The other 24 projectiles are then launched to hold or maintain the infra-red decoy, and to ensure that the bright spot moves in a receding direction from the vessel. (It is known that an infra-red decoy will first produce a bright spot which then tends to become diffuse).

The acquisition projectiles are associated with the lower sloping angles. They are thus located in the right-hand part of the pack illustrated in FIG. 1.

The two projectiles illustrated in detail in FIG. 4 are located in the pack at the limit between the location of the acquisition-projectiles and of the holding-projectiles. The right-hand projectile is thus an acquisition projectile, and that on the left is a holding projectile.

The projectile on the right 241 associated with the acquisition phase, is now described in greater detail. At the bottom of the mortar 240 for this projectile, an ignition charge 242 is located as previously, connected to the firing distribution network by means of a pyrotechnical ignition delay 243. The ignition charge 242 and the delay 243 are located in the bottom 244 of the mortar 240, which is secured on pegs 245, in such a way as to rest on the semi-circular bearing area defining the mortar sloping angle. The bottom 244 of the mortar extends towards the inside of the mortar 240 by means of a cylindrical section 247. The ends 248 of this cylindrical section 247 form claws retaining the component 250 on which the projectile rests, by means of the holding washer 256 located at the other end.

Starting from the component 250, the projectile 241 has a first casing 251 which is secured at its other end to a rotary striker 252. The rotary striker 252 has a further casing 253, which in turn finally comes to bear against the front part 254 of the projectile, complete with O-ring seal 255 and the holding washer 256 already referred to.

Essentially the rotary striker 252 is the same as the rotary striker 151 described with reference to FIG. 2. The primer 260 actuated by the striker as such (not shown here) reacts upon a radial pyrotechnical component 261, followed by two axial pyrotechnical components 262 and 263. These components 261 to 263 form trajectory pyrotechnical delays (eventually of differing natures). The components 262 and 263 react by means of pyrotechnical relays 264 and 265 respectively upon charges 266 and 267, which are located coaxially with the infra-red mixtures 268 and 269. The charges 266 and 267 operate at the same time as container-voiding and ignition -charges for the infra-red mixtures, that preferably comprise an aerosol.

The infra-red composition is selected for a brightness spreading over a wave-length extending from 3 to 5 microns and 8 to 14 microns, with a brightness spectral density in the second band which is approximately twice that of the first band. These infra-red mixtures are preferably also likely to produce a decoy in the range of visible radiations.

In this manner, the projectile ejection for the acquisition projectiles is effected by reaction of the charge 242, at the end of the delay defined by the ignition pyrotechnical delay 243. As soon as the projectile leaves the mortar, the rotary striker is actuated. At the end of the delay defined by the trajectory pyrotechnical delay(s) defined by components 261 to 263, the infra-red mixture is dispersed and ignited. As may be seen more closely with reference to Table 3, the acquisition projectile assembly forms the start of infra-red decoys in the vicinity of the vessel.

Variations on infra-red decoy projectiles are described in French Pat. Nos. 74 41205 and 76 06678, as well as French Pat. Nos. 74 40500 and 74 40781. Other advantageous variations comprising the emission of an aerosol, may be based on rockets described in French Pat. No. 75 02725 and the addition certificate No. 75 02726.

The left-hand projectile in FIG. 4 is an acquisition projectile. The active part of the projectile is the same as that in the right-hand projectile. This active part includes basically a rotary striker 352, actuating as described above infra-red mixtures 368 and 369 located to either side of the striker. However, this active part of the projectile is itself enclosed in an internal casing 370 which is surrounded by the mortar 340. Consequently the action of the rotary striker 352 only occurs after the projectile has left its internal casing 370.

As previously, this projectile comprises an ejection charge 342 located at the bottom of the mortar and ignited by an ignition pyrotechnical delay 343. The bottom 344 of the mortar is extended by a cylinder 347, with claws 348 at the end retaining the shell-casing 350 of the projectile. A pyrotechnical delay 351 which is ignited by the ejection charge, is located in the axis of the shell-casing 350. This pyrotechnical delay ensures the delaying of the opening of a parachute 380. For that purpose, the delay 351 ignites a charge 383, which explodes the shell-casing 350 of the projectile, as well as the lateral cylindrical wall 384. This simultaneously separates components 385, 386 and 387, thus releasing the paracute 380.

In a preferential design, the opening delays for the parachute increase in accordance with the increasing angles of the mortars in relation to the horizontal, for the holding phase projectiles. The said opening delays are selected in such a manner that the opening occurs immediately before- or at the high point of the trajectory of the projectile.

Starting from that point, the projectile descends with support from its parachute, and the head of the projectile is pointed downwards.

It will be recalled that after release from the mortar, the projectile retains an internal casing 370. At the rear this internal envelope is simultaneously closed by internal casing 370, upon which is secured the parachute by means of screw 371 for example.

The head of the projectile comprises a primary container-voiding charge 400, located inside component 401, which closes the internal casing 370 at the front. The charge 400 is subject to the reaction of a primer 403, which operates in conjunction with a cap primer 404. The head 405 of the cap primer is axially mobile within a component 406, which is secured to the front part 401 of the internal casing. Towards the front, component 406 has a projection 408 serving as a guide to a spring 409, which also bears upon the front end 410 of the projectile. The tail 411 of the striker is integral with this part 410.

Consequently the projectile descends head downwards, supported by its parachute. As soon as it comes into contact with the water, the cap primer 404 is stressed towards the primer 403, thus igniting the charge 400, and provoking the exit of the effective part of the projectile from the internal casing 370. This primary container-voiding occurs towards the rear part of the projectile, i.e. towards the top.

Consequently under the reaction of the primary container-voiding charge, the projectile issues from its internal casing 370 and rises to approximately 10 meters or so above the water level. Immediately on the exit of the internal casing 370, the rotary striker 352 is actuated. The final container-voiding and the release of the infra-red charge are consequently effected after the delay defined within this striker, counting from the primary container-voiding of the projectile.

Table 3 defines according to the projectile numbers, the angle of firing, the ignition delay, the initial speed as linked with the ejection charges, the parachute delays (where applicable), and the pyrotechnical trajectory delays.

Projectiles Nos. 1 to 9 are those for the acquisition phase, without parachute and consequently without parachute delays. The trajectory pyrotechnical delay is counted from the moment of ejection.

Projectiles Nos. 10 to 33 on the other hand, have a parachute delay, and their pyrotechnical delay is counted as from the primary container-voiding at sea-level.

TABLE 3

| No. | Firing angle (to horizontal) | Ignition delay (s) | $V_o$ (m/s) | Parachute delay (s) | Trajectory delay (s) | |
|---|---|---|---|---|---|---|
| 1 | 15 | 0.03 | 40 | — | 0.15 | |
| 2 | 15 | 0.03 | 100 | — | 0.15 | |
| 3 | 15 | 0.03 | 100 | — | 0.25 | |
| 4 | 30 | 0.07 | 80 | — | 0.15 | |
| 5 | 30 | 0.07 | 80 | | 0.25 | ACQUISITION PHASE |
| 6 | 30 | 0.07 | 100 | — | 0.25 | |
| 7 | 45 | 0.1 | 100 | — | 0.15 | |
| 8 | 60 | 0.1 | 60 | — | 0.15 | |
| 9 | 60 | 0.1 | 100 | — | 0.15 | |
| 10 | 60 | 0.2 | 30 | 0.1 | 0.1 | |
| 11 | 60 | 0.2 | 40 | 0.1 | 0.1 | |
| 12 | 60 | 0.2 | 50 | 0.1 | 0.1 | |
| 13 | 60 | 0.2 | 60 | 0.1 | 0.1 | |
| 14 | 60 | 0.2 | 70 | 0.1 | 0.1 | |
| 15 | 60 | 0.2 | 70 | 0.5 | 0.1 | |
| 16 | 60 | 0.3 | 70 | 0.5 | 0.1 | |
| 17 | 60 | 0.3 | 90 | 0.5 | 0.1 | |
| 18 | 60 | 0.3 | 60 | 1 | 0.1 | HOLDING PHASE |
| 19 | 60 | 0.3 | 70 | 1 | 0.1 | |
| 20 | 60 | 0.3 | 80 | 1 | 0.1 | |
| 21 | 60 | 0.3 | 100 | 1 | 0.1 | |
| 22 | 60 | 0.4 | 120 | 1 | 0.1 | |
| 23 | 60 | 0.4 | 140 | 1 | 0.1 | |
| 24 | 60 | 0.4 | 80 | 2 | 0.1 | |
| 25 | 60 | 0.4 | 100 | 2 | 0.1 | |
| 26 | 60 | 0.4 | 110 | 2 | 0.1 | |
| 27 | 60 | 0.4 | 130 | 2 | 0.1 | |
| 28 | 62 | 0.5 | 120 | 2.5 | 0.1 | |
| 29 | 66 | 0.5 | 140 | 2.5 | 0.1 | |
| 30 | 69 | 0.5 | 130 | 3 | 0.1 | |
| 31 | 72 | 0.5 | 150 | 3 | 0.1 | |
| 32 | 74 | 0.5 | 140 | 3.5 | 0.1 | |
| 33 | 75 | 0.5 | 150 | 3.5 | 0.1 | |

Table 3 shows several significant aspects of the invention.

In the sequence of increasing angles of the mortars in relation to the horizontal, the projectiles are associated with very closely adjoining and increasing ignition pyrotechnical delays. This feature allows the elimination of random dispersal of the decoys due to the winds.

It will also be noted that the trajectory pyrotechnical delays are all equal for the projectiles fitted with a parachute. This is the feature whereby the holding phase projectiles release their infra-red mixture at a predetermined altitude, effectively constant above sea-level.

It is essentially the parachute delay which defines the duration of the trajectory for the holding projectiles. These parachute opening-delays are preferably of an increasing nature in the sequence of increasing angles of the mortars in relation to the horizontal.

FIG. 5 illustrates the general characteristics as a function of time and distance for a cloud of infra-red decoys produced by means of the pack according to the invention. The lower axis shows the distance of release points for the infra-red decoys, counted as from the vessel. They are plotted for conditions of zero wind- and vessel speeds.

The upper axis indicates the corresponding time required for the release of the infra-red decoy.

It will be noted that during the acquisition phase, the first bright spot is formed close to the vessel (10 meters). As the 9 acquisition projectiles are progressively fired very rapidly, this initial bright point moves steadily away from the vessel up to a hundred meters or so. The holding phase projectiles are then called on to contribute towards the maintenance or holding of bright spots in the cloud of decoys, the said bright spots moving away progressively from the vessel to a minimum distance of approximately 100 meters (assuming zero wind- and vessel-speeds).

It is consequently in accordance with a most important feature of the invention that the projectiles (both for acquisition and for holding -purposes) are fired in the sequence of their distance of increasing release as related to the vessel.

Several features of the projectiles according to the invention are equally applicable to infra-red- as well as to electromagnetic- decoys, notably the double container-voiding controlled by a rotary striker.

The same applies to the ignition pyrotechnical delays which are spaced out in time.

In the case of the electromagnetic-type of pack, the projectiles are fired in the reverse order of their range, the furthermost going first. In the case of the infra-red pack the decoys are fired in order of ranges, i.e. the closest packs going first. In both cases the firing sequence defined by ignition pyrotechnical delays always follows the order thus laid down. This is most important to avoid the appearance of random components in the dispersal of decoys particularly in accordance with the winds.

Another important aspect is the double container-voiding, which as already seen is controlled by the rotary striker, by means of one or several trajectory pyrotechnical delays integrated with the rotary striker. The said trajectory pyrotechnical delays may thus have a structurally common part and a different part. According to one feature of the invention, the difference thus provided in the two trajectory pyrotechnical delays is such that the two half-charges of each projectile, which take off in opposing directions, are released in slightly differing points. Experiments have shown more particularly in the case of infra-red decoys, that this slight dispersion of the container-voiding points greatly contributes towards obtaining a sufficiently homogeneous cloud of decoys.

The flat clouds of decoys obtained with the packs according to the invention have a thickness of less than or equal to 15 meters.

Following the simultaneous- or very closely subsequent-firing of at least one infra-red pack (as in Table 3), and one- (as in Table 1) or two- electromagnetic packs (as in Tables 1 & 2) a cloud of infra-red decoys and a cloud of electromagnetic decoys are obtained, having an excellent common localization. The term common localization indicates here that the two clouds are sufficiently close to each other to be considered relative to the same vessel by missiles effecting a correlation of information emitted by radar- and infra-red- detectors.

Finally, it should be noted that the firing time for the packs is less than 1 second, both for the electromagnetic- as well as the infra-red version. The complete cloud of decoys can be developed in less than 3 seconds (packs in accordance with Tables 1 and 2 fired together). Acquisition of the cloud of infra-red decoys is obtained at the end of 1 second, whereas its holding lasts approximately 30 seconds, which is an advantage, since it corresponds with the life of a bright spot moving away from the vessel.

An example of application of the decoy-launcher packs according to the invention is now described with reference to FIG. 6. Packs such as 30 and 31 are mounted on a carriage as in 61. Preferably, this carriage itself ensures a sloping firing launch, at an angle of 80° for the site, and an angle of 6° for the location. Other carriages equally bearing packs for instance a second carriage 62 may also be incorporated. Each type of pack is identified by a specific shape, which is detected by the probes mounted on the carriage in each pack location.

Carriages such as 61 and 62 are controlled by slave-service units such as 71 and 72 allowing them to be directed by control means. The carriages are controlled by a computer 80 associated with a monitoring unit 81.

The threat constituted for instance by a self-guiding missile is detected either by radar detectors in the case of an electromagnetically guided missile, or by the vessel's own radar system, or by whatsoever other means such as an optical- or infra-red detection unit. All the information acquired is transmitted to the computer 80.

This installation 80 also receives navigational information such as the direction and the speed of the relevant wind, as well as the vessel -heading and -speed. According to the number of oncoming missiles and their directions, the wind speed in relation to the vessel as well as tactical considerations, the data processing system gives instructions to the carriages to release the decoys for which the application has been previously defined. Without knowledge of the characteristics of the striking missile, at least one infra-red decoy pack and one or several electromagnetic decoy packs are launched (two packs are used in fact to obtain a large cloud of electromagnetic decoys as illustrated in FIG. 3).

It has been found that the packs according to the invention are an essential means of obtaining an excellent foiling or frustating means for missiles by way of such an installation.

What is claimed is:

1. A decoy-launching pack for mounting on a directional carriage for foiling or frustrating weapons guidance systems, comprising:

a rigid base suitable for positioning in a predetermined manner on said carriage, a firing means incorporated with said base for operation in conjunction with a firing-control component integrated in said carriage when said base is located thereupon, a support located above and secured to said base and having an upper extremity in the general shape of a rack, said rack comprising a group of bearing surfaces, each bearing surface being at a predetermined angled slope different than the slope of every other bearing surface in the group, a firing transmission pyrotechnical chain, extending from said firing means to the level of said angled slopes of the upper surface of said support, a plurality of mortars, the lower extremity of each such mortar bearing upon a different one of such bearing surfaces whereby each of such mortars is at a precise predetermined angle relative to each other, said mortars being predirected in the same plane, according to such predetermined angularly sloped bearing surfaces, and within each said mortar, at least one decoy-carrying projectile, said predetermined angled slopes being preselected in relationship with at least the launching velocities due to the individual ejection charges and the associated firing delays for producing a substantially uniform planar cloud of decoys.

2. A decoy-launching pack according to claim 1, in which said rigid base is associated with a housing, said base and housing together defining a sealed casing.

3. A decoy-launching pack according to claim 1, in which said firing means comprise two triggering units connected to two electrodynamic energising units located within a sealed housing.

4. A decoy-launching pack according to claim 1, in which said pyrotechnical chain is interlinked and provides a double firing distribution.

5. A decoy-launching pack according to claim 1, in which said ejection charges comprise ignition pyrotechnical delays providing different delays, whereby the take-off of projectiles and consequently the stresses imposed upon said carriage is spaced out in time.

6. An assembly of decoy launching packs according to claim 1, comprising at least one pack in which said projectiles are infra-red decoy launchers, and comprise a casing and at least one trajectory pyrotechnical delay within said casing, said trajectory pyrotechnical delay being suitable for triggering an infra-red diffusion charge which spreads and ignites an infra-red mixture, and at least one pack in which said projectiles are electromagnetic decoy-launchers, and comprise within a casing a trajectory pyrotechnical delay and a container-voiding charge connected thereto for actuating electromagnetic decoy dispersal means, said packs being intended for firing together to obtain a common location for an infra-red decoy and an electromagnetic decoy.

7. A decoy-launching pack according to claim 1 wherein the difference between the smallest angled slope to the largest angled slope is not greater than about 70°.

8. A decoy-launching pack according to claim 1, in which at least some of said projectiles comprise a striker actuated on release from said mortar, said striker itself triggering at least one trajectory pyrotechnical delay which controls a decoy-container voiding operation.

9. A decoy-launching pack according to claim 8, in which said projectiles are of the double container-voiding type controlled by said striker and said trajectory pyrotechnical delay, comprising on either side of said striker two container-voiding charges for said decoys actuated by said trajectory pyrotechnical delay and two decoy-loads.

10. A decoy-launching pack according to claim 1, in which said projectiles are electromagnetic decoy-launchers, and comprise within a casing a trajectory pyrotechnical delay and a container-voiding charge connected thereto for actuating electromagnetic decoy dispersal means.

11. A decoy-launching pack according to claim 10, in which the lengths of dipoles forming said electromagnetic decoys are varied to cover the frequency band extending from 7 to 18 GHz, with an essentially uniform spectral density.

12. A decoy-launching pack according to claim 10, in which said projectiles are distributed in groups each of which is associated with the same said ejection charge, and consequently the same initial speed, and have the same trajectory pyrotechnical delay.

13. A decoy-launching pack according to claim 12, in which said projectiles in the same said group are associated with very closely approximating ignition pyrotechnical delays, said delays being smaller for the projectiles of higher initial speed.

14. A decoy-launching pack according to claim 12, in which said projectiles in each said group are located in mortars having staggered elevation angles, so that the voiding points for the decoy-containers are located in essentially equidistant sections of an arc.

15. A decoy-launching pack according to claim 1, in which said projectiles are infra-red decoy-launchers, and comprise a casing, and at least one trajectory pyrotechnical delay within said casing, said trajectory pyrotechnical delay being suitable for triggering an infra-red diffusion charge which spreads and ignites an infra-red mixture.

16. A decoy-launching pack according to claim 15, in which said infra-red mixture is selected to provide radiation distributed over the wavelength bands extending firstly from 3 to 5 microns and secondly from 8 to 14 microns, said second band having a spectral density of approximately twice the brightness of said first band.

17. A decoy-launching pack according to claim 15, in which in the sequence of increasing angles of the mortars in relation to the horizontal, said projectiles are associated with ignition pyrotechnical delays providing closely approximately and increasing delays.

18. A decoy-launching pack according to claim 15, in which, with the exception of certain said projectiles associated with the smallest elevation angles, said projectiles include a rear parachute arranged to open after a predetermined delay, and a cap-rocket having a striker actuated on impact with water, itself controlling a container-voiding charge which raises said projectile to a predetermined height above the water, whilst the ignition of said infra-red mixture occurs after the aforesaid trajectory pyrotechnical delay, counting from the moment of container-voiding.

19. A decoy-launching pack according to claim 18, in which said parachute is normally enclosed within a casing located at the rear of said projectile, and is released following the action of a casing-opening pyrotechnical charge, and said projectile comprises a pyrotechnical parachute opening delay ignited by said ejection charge and reacting upon said opening charge, said parachute opening delay being selected so that opening occurs in the immediate vicinity before the high point of the projectile trajectory.

20. A decoy-launching pack according to claim 18, in which said trajectory pyrotechnical delays are equal for all said projectiles fitted with a parachute, and said parachute opening delays increase in the sequence of increasing angles of the mortars in relation to the horizontal.

21. A decoy-launching pack for mounting on a directional carriage for foiling or frustrating weapons guidance systems, comprising:

a rigid base suitable for positioning in a predetermined manner on said carriage, a firing means incorporated with said base for operation in conjunction with a firing-control component integrated in said carriage when said base is located thereupon, said firing means comprising two triggering units connected to two electrodynamic energizing units located within a sealed housing, a support located above and secured to said base and having a rack-shaped upper surface defining predetermined angled slopes, a firing transmission pyrotechnical chain, extending from said firing means to the level of said angled slopes of the upper surface of said support, a plurality of mortars with an ejection charge at the bottom bearing upon said angled slopes of said upper surface of said support, said mortars being predirected in the same plane, according to predetermined angles related to those of said angled slopes of the support surface, and, within each said mortar, at least one decoy-carrying projectile.

22. A decoy-launching pack for mounting on a directional carriage for foiling or frustrating weapons guidance systems, comprising:

a rigid base suitable for positioning in a predetermined manner on said carriage, a firing means incorporated with said base for operation in conjunction with a firing-control component integrated in said carriage when said base is located thereupon, a support located above and secured to said base and having a rack-shaped upper surface defining predetermined angled slopes, a firing transmission pyrotechnical chain, extending from said firing means to the level of said angled slopes of the upper surface of said support, and wherein said pyrotechnical chain is interlinked and provides a double-firing distribution, a plurality of mortars with an ejection charge at the bottom bearing upon said angled slopes of said upper surface of said support, said mortars being predirected in the same plane, according to predetermined angles related to those of said angled slopes of the support surface, and within each said mortar, at least one decoy-carrying projectile.

23. A decoy-launching pack for mounting on a directional carriage for foiling or frustrating weapons guidance systems, comprising:

a rigid base suitable for positioning in a predetermined manner on said carriage, a firing means incorporated with said base for operation in conjunction with a firing-control component integrated in said carriage when said base is located thereupon, a support located above and secured to said base and having a rack-shaped upper surface defining predetermined angled slopes, a firing transmission pyrotechnical chain, extending from said firing means to the level of said angled slopes of the upper surface of said support, a plurality of mortars with an ejection charge at the bottom bearing upon said angled slopes of said upper surface of said support, said mortars being predirected in the same plane, according to predetermined angles related to those of said angled slopes of the support surface, and within each said mortar, at least one decoy-carrying projectile and wherein at least some of said projectiles comprise a striker actuated on release from said mortar, said striker itself triggering at least one trajectory pyrotechnical delay which controls a decoy-container voiding operation.

24. A decoy-launching pack according to claim 23 in which said projectiles are of the double container voiding type controlled by said striker and said trajectory pyrotechnical delay, comprising an either side of said striker two container-voiding charges for said decoys actuated by said trajectory pyrotechnical delay and two decoy loads.

25. A decoy-launching pack for mounting on a directional carriage for foiling or frustrating weapons guidance systems, comprising:

a rigid base suitable for positioning in a predetermined manner on said carriage, a firing means incorporated with said base for operation in conjunction with a firing-control component integrated in said carriage when said base is located thereupon, a support located above and secured to said base and having a rack-shaped upper surface defining predetermined angled slopes, a firing transmission pyrotechnical chain, extending from said firing means to the level of said angled slopes of the upper surface of said support, a plurality of mortars with an ejection charge at the bottom bearing upon said angled slopes of said upper surface of said support, said mortars being predirected in the same plane, according to predetermined angles related to those of said angled slopes of the support surface, within each said mortar, at least one decoy-carrying projectile, and wherein said projectiles are infra-red decoy launchers, and comprise a casing, and at least one trajectory pyrotechnical delay within said casing, said trajectory pyrotechnical delay being suitable for triggering an infra-red diffusion charge which spreads and ignites an infra-red mixture, and wherein with the exception of certain said projectiles associated with the smallest elevation angles, said projectiles include a rear parachute arranged to open after a predetermined delay, and a cap-rocket having a striker actuated on impact with water, itself controlling a container-voiding charge which raises said projectile to a predetermined height above the water, whilst the ignition of said infra-red mixture occurs after the aforesaid trajectory pyrotechnical delay, counting from the moment of container voiding.

26. A decoy-launching pack according to claim 25 in which said parachute is normally enclosed within a casing located at the rear of said projectile, and is released following the action of a casing-opening pyrotechnical charge, and said projectile comprises a pyrotechnical parachute-opening delay ignited by said ejection charge and reacting upon said opening charge, said parachute-opening delay being selected so that opening occurs in the immediate vicinity before the high point of the projectile trajectory.

27. A decoy-launching pack according to claim 25 in which said trajectory pyrotechnical delays are equal for all said projectiles fitted with a parachute, and said parachute-opening delays increase in the sequence of increasing angles of the mortars in relation to the horizontal.

* * * * *

UNITED STATES PATENT AND TRADEMARK OFFICE

CERTIFICATE OF CORRECTION

PATENT NO. : 4,222,306

DATED : September 16, 1980

INVENTOR(S) : Louis Maury

It is certified that error appears in the above—identified patent and that said Letters Patent is hereby corrected as shown below:

In [57] ABSTRACT, Line 9, "the" should read -- a --. Column 2, Lines 48 and 49, "con-tainerrelease" should read -- con-tainer-release --. Column 5, Line 31, "tromagneticor" should read -- tromagnetic - or --; Line 38, "tainerrelease" should read -- tainer-release --. Column 6, Line 11, ":" should read -- . --; line 12, "the" first occurrence should read -- The --. Line 39, "containerrelease" should read -- container-release --. Column 9, Line 26, "wave-length" should read -- wavelength --. Column 13, Line 47, "installation" should read -- computer --. Column 15, Claim 17, Line 49, "approximately" should read -- approximating --.

Signed and Sealed this

*Fifth* Day of *May 1981*

[SEAL]

*Attest:*

RENE D. TEGTMEYER

*Attesting Officer* *Acting Commissioner of Patents and Trademarks*